US011291600B2

(12) United States Patent
Van Raemdonck et al.

(10) Patent No.: US 11,291,600 B2
(45) Date of Patent: Apr. 5, 2022

(54) HOIST WITH HANDLE

(71) Applicant: Handi-Move International NV, Ninove (BE)

(72) Inventors: Stefan Van Raemdonck, Herzele (BE); Paul Van Raemdonck, Aspelare (BE)

(73) Assignee: HANDI-MOVE N.V., Ninove (BE)

( * ) Notice: Subject to any disclaimer, the term of this patent is extended or adjusted under 35 U.S.C. 154(b) by 174 days.

(21) Appl. No.: 16/426,318

(22) Filed: May 30, 2019

(65) Prior Publication Data

US 2019/0365587 A1 Dec. 5, 2019

(30) Foreign Application Priority Data

May 30, 2018 (BE) ..... 2018/5358

(51) Int. Cl.
*A61G 7/10* (2006.01)
*A61G 7/053* (2006.01)

(52) U.S. Cl.
CPC ..... *A61G 7/1017* (2013.01); *A61G 7/053* (2013.01); *A61G 7/1046* (2013.01); *A61G 7/1049* (2013.01); *A61G 7/1082* (2013.01)

(58) Field of Classification Search
CPC .... A61G 7/053; A61G 7/1017; A61G 7/1046; A61G 7/1049; A61G 7/1051; A61G 7/1082; A61G 7/1096; A61G 7/1098; A61H 1/0229; A61H 2201/0192; A61H 2201/1207; A61H 2201/1635
See application file for complete search history.

(56) References Cited

U.S. PATENT DOCUMENTS 5,309,584 A * 5/1994 Parker ..... A61G 7/1017 5/86.1
5,502,851 A * 4/1996 Costello ..... A61H 3/04 482/69
5,878,450 A * 3/1999 Bouhuijs ..... A61G 7/1046 5/86.1
5,892,180 A * 4/1999 Carey ..... G01G 19/44 177/144
6,119,287 A * 9/2000 Phillips ..... A61G 7/1017 5/81.1 RP (Continued)

FOREIGN PATENT DOCUMENTS

CN 106236423 A 12/2016
EP 1452160 A1 * 9/2004 ..... A61G 7/1096
JP 2010246635 A 11/2010

OTHER PUBLICATIONS

Belgian Search Report from BE Application No. 201805358, dated Jan. 30, 2019.

*Primary Examiner* — David R Hare
(74) *Attorney, Agent, or Firm* — Workman Nydegger

(57) ABSTRACT

In a first aspect, the present invention relates to a hoist for facilitating a transition between firstly a seated or lying position and secondly a standing position of an individual, comprising: a movable lifting arm for exerting a lifting force, a connecting element for transferring the lifting force from the lifting arm to the individual, and a movable handle suitable for supporting the hands of the individual during operation of the hoist, wherein the movable handle is configured to shift during operation of the hoist, wherein during operation of the hoist, the movable handle also executes a movement relative to the lifting arm.

17 Claims, 5 Drawing Sheets

(56) References Cited

U.S. PATENT DOCUMENTS

| | | | | |
|---|---|---|---|---|
| 6,175,973 | B1 * | 1/2001 | Hakamiun | A61G 7/1017 5/86.1 |
| 6,389,619 | B1 * | 5/2002 | Dunn | A61G 7/1017 5/81.1 R |
| 6,581,222 | B1 * | 6/2003 | Liljedahl | A61G 7/1017 5/89.1 |
| 7,356,858 | B2 * | 4/2008 | Summers | A61G 7/1015 5/83.1 |
| 7,392,554 | B1 * | 7/2008 | Su | A61G 7/1017 5/86.1 |
| 8,650,677 | B2 * | 2/2014 | Altena | A61G 5/14 5/87.1 |
| 9,364,379 | B2 * | 6/2016 | Hammond | A61G 7/1048 |
| 10,238,564 | B2 * | 3/2019 | Fakhrizadeh | A61G 7/1074 |
| 10,729,604 | B2 * | 8/2020 | Tsusaka | A61G 7/1046 |
| 2005/0217025 | A1 * | 10/2005 | Barallia | A61G 7/1094 5/86.1 |
| 2015/0190293 | A1 * | 7/2015 | Hacikadiroglu | A61G 7/1017 5/87.1 |
| 2019/0054335 | A1 * | 2/2019 | Yeh | A63B 21/4003 |

* cited by examiner

HOIST WITH HANDLE

FIELD OF THE INVENTION

This invention relates in general to hoists for helping an individual to reach a standing position or a seated or lying position. More particularly, this invention relates to handles used in such hoists.

BACKGROUND OF THE INVENTION

Hoists which help an individual into or out of a standing position are well known. Advantageously, they provide assistance for individuals who have difficulty in transferring independently from a seated position to a standing position, or from a standing position to a seated position, such as the elderly or patients in a hospital. Hoists typically comprise a lifting arm and a lifting strap connected thereto which is placed around the trunk of the individual. A lifting force from the lifting arm is transferred to the individual via the lifting strap, facilitating the transition between a lying/seated and a standing position.

On use of known hoists, the individual however typically tends to grip the lifting arm in front of him, presumably from a subjective feeling of safety. The arms however thus come into a position (e.g. above shoulder height) which makes it easier for the lifting strap to slip, whereby for example it can slip upward to below the shoulders of the individual. In this situation, the individual's comfort is significantly reduced and safety may even be threatened.

There is therefore room for improvement of hoists.

SUMMARY OF THE INVENTION

It is an object of embodiments of the present invention to provide good hoists and good methods for use of these hoists. This object is achieved by a device, a method and/or a use according to the present invention.

In a first aspect, the present invention concerns a hoist for facilitating a transition between firstly a seated or lying position and secondly a standing position of an individual, comprising:

i. a movable lifting arm for exerting a lifting force;
ii. a connecting element for transferring the lifting force from the lifting arm to the individual, and
iii. a movable handle suitable for supporting the hands of the individual during operation of the hoist, wherein the movable handle is configured to shift during operation of the hoist, and wherein during operation of the hoist, the movable handle also executes a movement relative to the lifting arm.

It is an advantage of embodiments of the present invention that the comfort and/or safety of the individual (i.e. the user of the hoist, such as for example the patient or the elderly person) may be increased.

It is an advantage of embodiments of the present invention that efficient hoists may be obtained, i.e. hoists which allow users to switch between a lying/seated position and a standing position in an efficient manner.

In embodiments, the handle may be positioned such that when the individual grips the handle, an angle between an arm and a torso of the individual is less than or equal to 90°, preferably less than or equal to 70°, more preferably less than or equal to 50°, even more preferably less than or equal to 30°. The upper arm horizontally at shoulder height corresponds to an angle of 90°, while the upper arm next to the body corresponds to an angle of 0°.

It is an advantage of embodiments of the present invention that a connecting element (e.g. a lifting strap) may remain well positioned around the user during use of the hoist. It is a further advantage of embodiments of the present invention that during use of the hoist, the connecting element does not shift to an uncomfortable and/or unsafe position.

It is an advantage of embodiments of the present invention that the hoist, e.g. the position of the handle, can be matched to the individual.

In embodiments, the handle may be configured relative to the lifting arm such that, during operation of the hoist, in a first phase, the lifting arm is in motion but not the handle, and in a second phase, both the handle and the lifting arm are in motion. In other words, during a lifting action, the movement of the movable handle is delayed with respect to the movement of the lifting arm. In some embodiments, the movable handle—during a lifting action—only moves after the connecting element (e.g. lifting strap), which is mounted on the individual, is brought under mechanical tension by moving the lifting arm.

According to some embodiments, the movable handle may move around a different pivoting point than the lifting arm. It is an advantage of embodiments of the present invention that the handle is not fixed, but moves depending on the phase of operation of the hoist. It is a further advantage of embodiments of the present invention that throughout the operation, the handle can remain in a good position, i.e. a position in which the user's attitude is comfortable and in which the connecting element does not slip into uncomfortable positions on the user's body.

In embodiments, the handle may be connected to the lifting arm in such a way that a force and/or a movement from the lifting arm in the first phase is not transferred to the handle, and in the second phase is transferred to the handle.

The connection between the movable handle and the lifting arm may be a non rigid connection.

It is an advantage of embodiments of the present invention that the movement of the handle can be coupled to the movement of the lifting arm, while a relative movement between the two is still obtained.

It is an advantage of embodiments of the present invention that a relative movement between the handle and the lifting arm can be obtained in a relatively large number of ways. It is a further advantage of embodiments of the present invention that this principle may therefore be integrated in a variety of hoist models.

In embodiments, the movement of the handle may comprise a rotation about a rotation point, and the force from the lifting arm on the handle may be an upward force with a proximal point of attack relative to the rotation point, viewed from the individual.

In embodiments, the movement of the handle may comprise a rotation about a rotation point, and the force from the lifting arm on the handle may be a downward force with a distal point of attack relative to the rotation point, viewed from the individual.

In embodiments, the lifting arm and the handle may be connected by means of the chain or a pivoting coupling element, wherein the maximal length of the chain or pivoting coupling element is greater than the distance between the lifting arm and the handle in the first phase of operation of the hoist.

In embodiments, the hoist may comprise a separate actuator for the handle and a separate actuator for the lifting arm.

It is an advantage of some embodiments of the present invention that the handle can be actuated separately from the lifting arm.

In embodiments, the handle may be configured relative to the lifting arm such that during operation of the hoist, the handle moves at a different speed from the lifting arm.

It is an advantage of embodiments of the present invention that the lifting arm and handle may be situated at different distances, despite their movements being coupled.

In some embodiments, the handle may move more slowly than the lifting arm.

In some embodiments, the lifting arm and the handle may be driven by the same motor.

It is an advantage of some embodiments of the present invention that no extra motor need be provided for moving the handle.

In embodiments, the connecting element may be a lifting strap to be placed around the individual. The lifting strap may be connected to the lifting arm.

It is an advantage of embodiments of the present invention that the individual can be coupled to the hoist in a relatively simple and safe manner.

In embodiments, the lifting strap may be placed around a torso of the individual.

It is an advantage of embodiments of the present invention that the coupling may be relatively comfortable and/or safe.

In a second aspect, the present invention relates to a method for transferring an individual between firstly a seated or lying position and secondly a standing position, comprising:

a. connecting an individual to a hoist according to the first aspect by means of the connecting element,
b. gripping of the handle by the individual, and
c. operation of the hoist, thus facilitating the transition between firstly the seated or lying position and secondly the standing position of the individual.

In a third aspect, the present invention relates to a handle in a hoist according to an embodiment of the first aspect, wherein the handle shifts during operation of the hoist and executes a movement relative to the lifting arm of the hoist.

Specific and preferred aspects of the invention are described in the attached independent and dependent claims. Features of the dependent claims may be combined with features of the independent claims and with features of other dependent claims as indicated, and not simply as expressly presented in the claims.

These and other aspects of the invention will become clear and be explained with reference to the embodiment(s) described below.

Figure 1A:
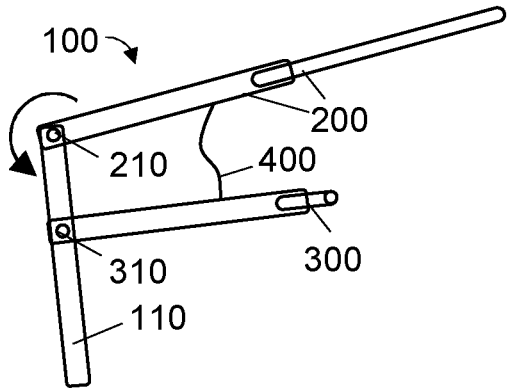
FIGS. 1(*a*) to 4 illustrate diagrammatic depictions of various hoists according to exemplary embodiments of the present invention.
Figure 1B:
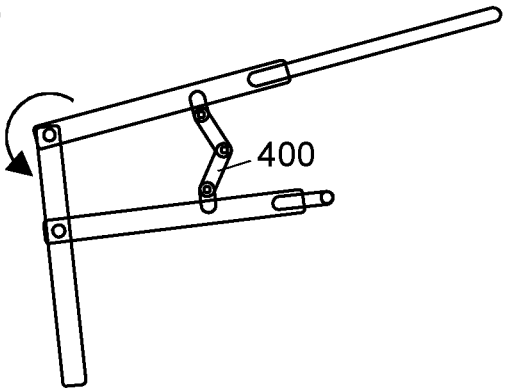
Figure 1C:
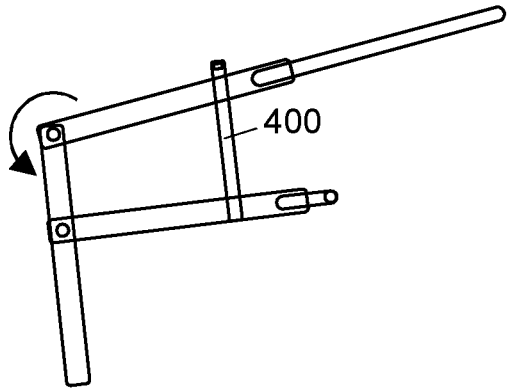
Figure 1D:
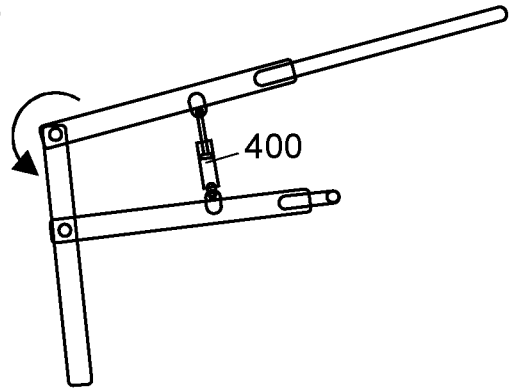
Figure 1E:
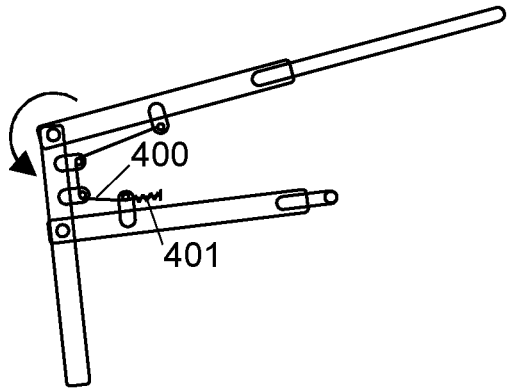
Figure 1F:
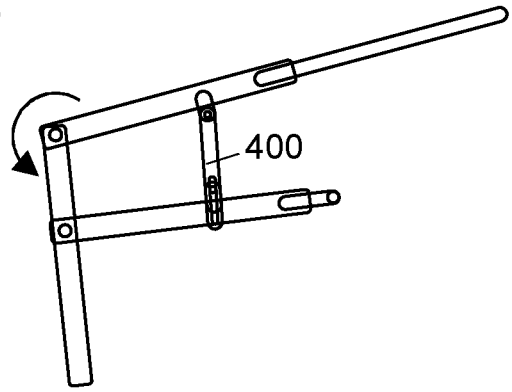

The drawings are purely diagrammatic and not limitative. In the drawings, the dimensions of some components may be exaggerated and not shown to scale for illustrative purposes.

Reference numbers in the claims should not be interpreted as restricting the scope of protection. In the various drawings, the same reference numbers refer to the same or equivalent elements.

DETAILED DESCRIPTION OF ILLUSTRATIVE EMBODIMENTS

The present invention will be described in relation to particular embodiments and with reference to specific drawings, but the invention is not restricted thereto and is limited solely by the claims. The drawings described are purely diagrammatic and not limitative. In the drawings, for illustrative purposes, the dimensions of some elements are exaggerated and not drawn to scale. The dimensions and relative dimensions sometimes do not correspond to the actual practical embodiment of the invention.

Furthermore, the terms "first", "second", "third" and similar in the description and in the claims serve to distinguish equivalent elements and not necessarily to describe an order in either time or space, or in priority or in any other way. It should be understood that the terms used in this way are interchangeable under certain circumstances, and that the embodiments of the invention described herein are suitable for working in other orders than described or shown herein.

In addition, the terms "above", "below", "in front of", "lower" and similar in the description and in the claims are used for descriptive purposes and not necessarily to define relative positions. It should be understood that the terms used in this way may under given circumstances can be exchanged for their antonyms, and that the embodiments of the invention described herein are also suitable for working with other orientations than described or shown herein.

It should be noted that the terms "comprise" and "contain" as used in the claims should not be interpreted as limited to the means described thereafter; these terms do not exclude other elements or steps. They should be interpreted as specifying the presence of the indicated features, values, steps or components to which reference is made, but do not exclude the presence or addition of one or more other features, values, steps or components or groups thereof. Therefore, the scope of the expression "a device comprising means A and B" should not be limited to devices which consist solely of components A and B. It means that with regard to the present invention, A and B are the only relevant components of the device.

Reference throughout this specification to "one embodiment" or "an embodiment" means that a specific feature, structure or characteristic described in connection with the embodiment is included in at least one embodiment of the present invention. Therefore, the expressions "in one embodiment" or "in an embodiment" at various points throughout the specification need not necessarily each refer to the same embodiment, but may well do so. Furthermore, the specific features, structures or characteristics may be combined in any suitable manner in one or more embodiments, as will be clear to an average person skilled in the art on the basis of this publication.

Similarly, it should be appreciated that the various features of the invention given in the description of exemplary embodiments of the invention may sometimes be grouped into a single embodiment, figure or description thereof, with the aim of streamlining the disclosure and assisting with comprehension of one or more of the various inventive aspects. This method of disclosure should not be interpreted as reflecting an intention that the invention requires more features than explicitly stated in each claim. Rather, as the following claims show, inventive aspects exist in less than all features of a single, previously disclosed embodiment. Therefore, the claims following the detailed description are hereby explicitly included in this detailed description, with each autonomous claim as a separate embodiment of this invention.

Furthermore, while some embodiments described herein comprise some but not other features included in other embodiments, combinations of features of different embodiments are considered to lie within the scope of the invention and form different embodiments, as will be understood by the skilled person. For example, in the claims which follow, any embodiments described may be used in any combination.

In the description provided here, numerous specific details are emphasised. It should however also be understood that embodiments of the invention may be implemented without these specific details. In other cases, well-known methods, structures and techniques are not presented in detail, in order to keep this description concise.

In a first aspect, the present invention concerns a hoist for facilitating a transition between firstly a seated or lying position and secondly a standing position of an individual. Such hoists are for example particularly advantageous for assisting individuals who have difficulty in moving independently between a standing position and a seated or lying position, such as for example the elderly, patients in a hospital etc.

The hoist according to embodiments of the present invention comprises a movable lifting arm for exerting a lifting force, a connecting element for transferring the lifting force from the lifting arm to the individual, and a movable handle. The movable handle is suitable for supporting the hands of the individual during operation of the hoist and is configured to shift during operation of the hoist. During operation of the hoist, more specifically during at least part of the operation, the movable handle executes a movement relative to the lifting arm.

In embodiments, the hoist may be used both for transition from the seated or lying position to the standing position, and from the standing position to the seated or lying position. By means of the lifting force exerted by the lifting arm, the hoist can apply a lifting movement to the individual and an opposite movement (e.g. slow down and/or control the natural falling motion).

In embodiments, the lifting arm may be movable by rotation and/or translation. The lifting arm may for example be connected to a further part of the hoist (for example a stand) by means of a connecting point. The movable lifting arm may for example be rotatable about this connecting point, and/or the movable lifting arm may be translatable by for example an upward or downward movement of the connecting point. In some embodiments, the movable lifting arm may combine rotation and translation.

In embodiments, the connecting element may be a lifting strap for placing around the individual and connecting to the lifting arm. In embodiments, the lifting strap may be placed around the torso (e.g. a trunk or middle) of the individual. The lifting strap may for example be attached to the lifting arm at one end, run around the individual's back, and be attached to the lifting arm again at the other end. In embodiments, the connecting element may also be a more extensive system such as a harness. The connecting element may be adapted to increase the comfort and/or safety of the individual. Thus, the connecting element may be made of a partially compressible material (e.g. a foam) and/or have an anti-slip surface in zones which make contact with the individual. The connecting element may be designed such that it can be fastened around the individual, for example by means of a Velcro tape or a hook and eye system, or in any other manner which allows the connecting element to be securely fastened around the individual.

In embodiments, the handle, which is suitable for supporting the hands of the patient during operation of the hoist, may have a suitable form, a suitable material and/or a suitable position. A suitable form may for example be a shape which allows the handle to be gripped easily and well, such as an ergonomic shape. A suitable material may for example be a material which is sufficiently stiff, and/or which allows the handle to be gripped firmly.

In embodiments, the handle may be positioned such that when the individual grips the handle, an angle between an arm and a torso of the individual is less than or equal to 90°, preferably 70°, more preferably 50°, even more preferably 30°. The handle may thus advantageously be positioned such that the arm is oriented at shoulder height (i.e. 90°) or lower. In embodiments, the movement of the handle during operation of the hoist may be such that the angle between the arm and the torso is always less than or equal to 90°, preferably 70°, more preferably 50°, even more preferably 30°.

A relative movement of the handle relative to the lifting arm during operation of the hoist may advantageously be achieved in various ways. In a first form, the handle may be configured relative to the lifting arm such that, during operation of the hoist, in one phase e.g. a first phase, the lifting arm is in motion but not the handle, and in another phase e.g. a second phase, both the handle and the lifting arm are in motion.

In a second form, the handle may be configured relative to the lifting arm such that, during operation of the hoist, the handle moves at a different speed (e.g. more slowly) than the lifting arm. In embodiments, only the first or only the second form may occur. In other embodiments, both the first and the second form may be combined sequentially or simultaneously.

In embodiments, the handle may be connected to the lifting arm in such a way that the force from the lifting arm in the first phase is not transferred to the handle and in the second phase is transferred to the handle.

In embodiments, the movement of the handle may comprise a rotation about a rotation point, and the force from the lifting arm on the handle may be an upward force with a proximal point of attack relative to the rotation point, viewed from the individual. In embodiments, the lifting arm and the handle may be connected by means of a coupling element (e.g. a chain or pivoting coupling element), wherein the maximal length of the coupling element is greater than the distance between the lifting arm and the handle in the first phase of operation of the hoist. The coupling element may for example be a chain, a belt, a shackle connection, a bridge connection, a piston, a guided chain or belt (optionally equipped with the spring), or a sliding shackle connection. Such embodiments are shown for example in FIGS. 1(*a*) to 1(*f*) (see below).

In embodiments, the movement of the handle may comprise a rotation about a rotation point, and the force from the lever arm on the handle may be a downward force with a distal point of attack relative to the rotation point, viewed from the individual. Such embodiments are shown for example in FIGS. 2(*a*) and 2(*b*) (see below).

In embodiments, the hoist may comprise a separate actuator for the handle and a separate actuator for the lifting arm. Such embodiments are shown for example in FIGS. 3(*a*) and 3(*b*) (see below).

In embodiments, the lifting arm and the handle may be driven by the same motor.

In embodiments, in the hoist, the handle may also be attached to the lifting arm with a rotation point, as shown for example in FIG. 4 (see below).

Further standard and optional features of the hoist according to embodiments of the present invention may correspond to hoists known from the prior art. Thus, hoists according to embodiments of the present invention may also comprise a stand to which the lifting arm and handle are linked. Such a stand may for example be a tubular structure, although the invention is not limited to this. The hoist may also be provided with wheels so that the hoist can easily be displaced. The hoist may furthermore also be provided with a plate or bar on which the user's feet may be placed. Typically, the hoist also comprises a motor for driving the movement of the actuator or actuators in some embodiments of the present invention. The specific type of motor which may be used is not limitative for the present invention.

Figure 5:
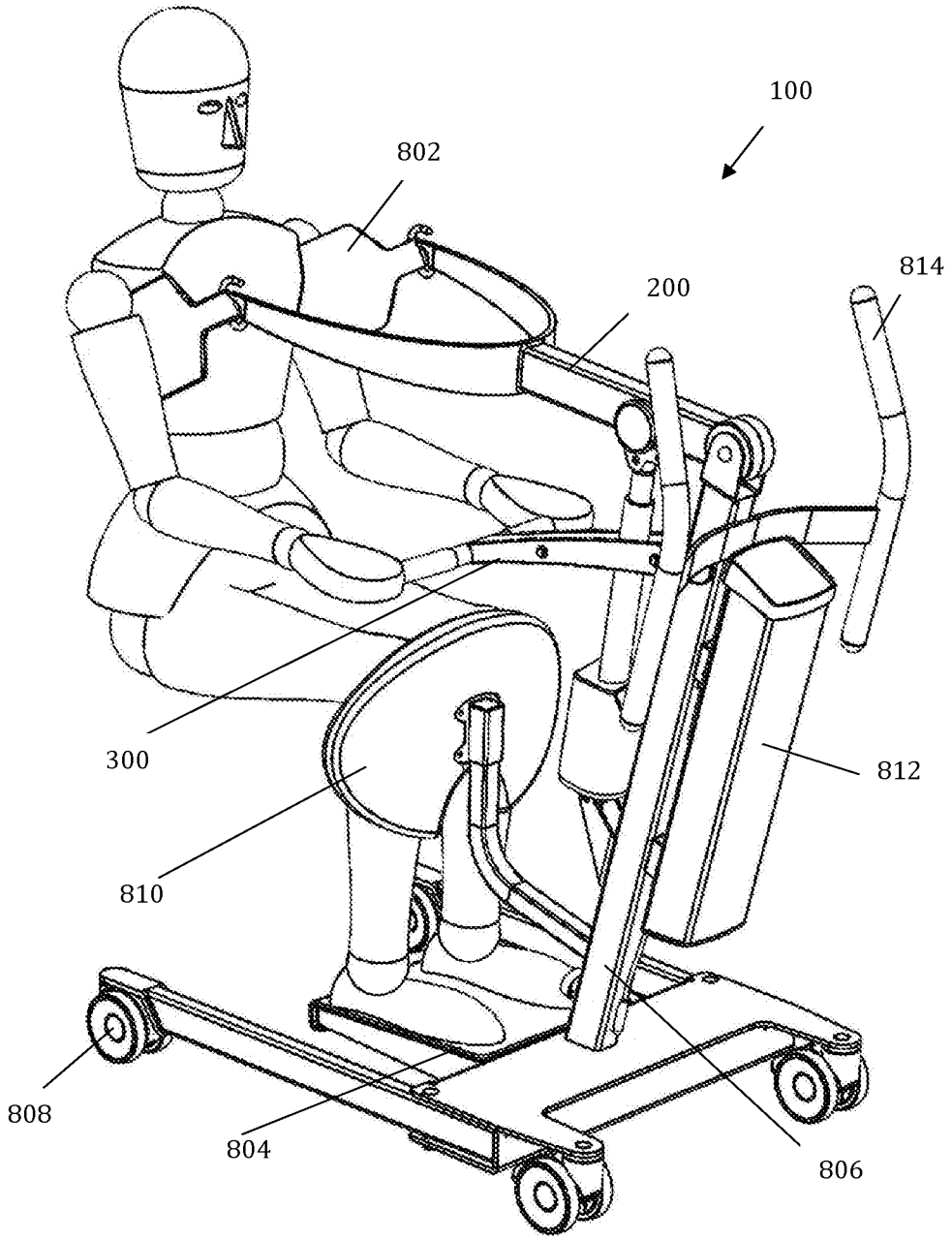
FIG. 5 and FIG. 6 illustrate different views of a diagrammatic depiction of a user in a hoist according to one embodiment of the present invention, wherein the user is in a seated position.
Figure 6:
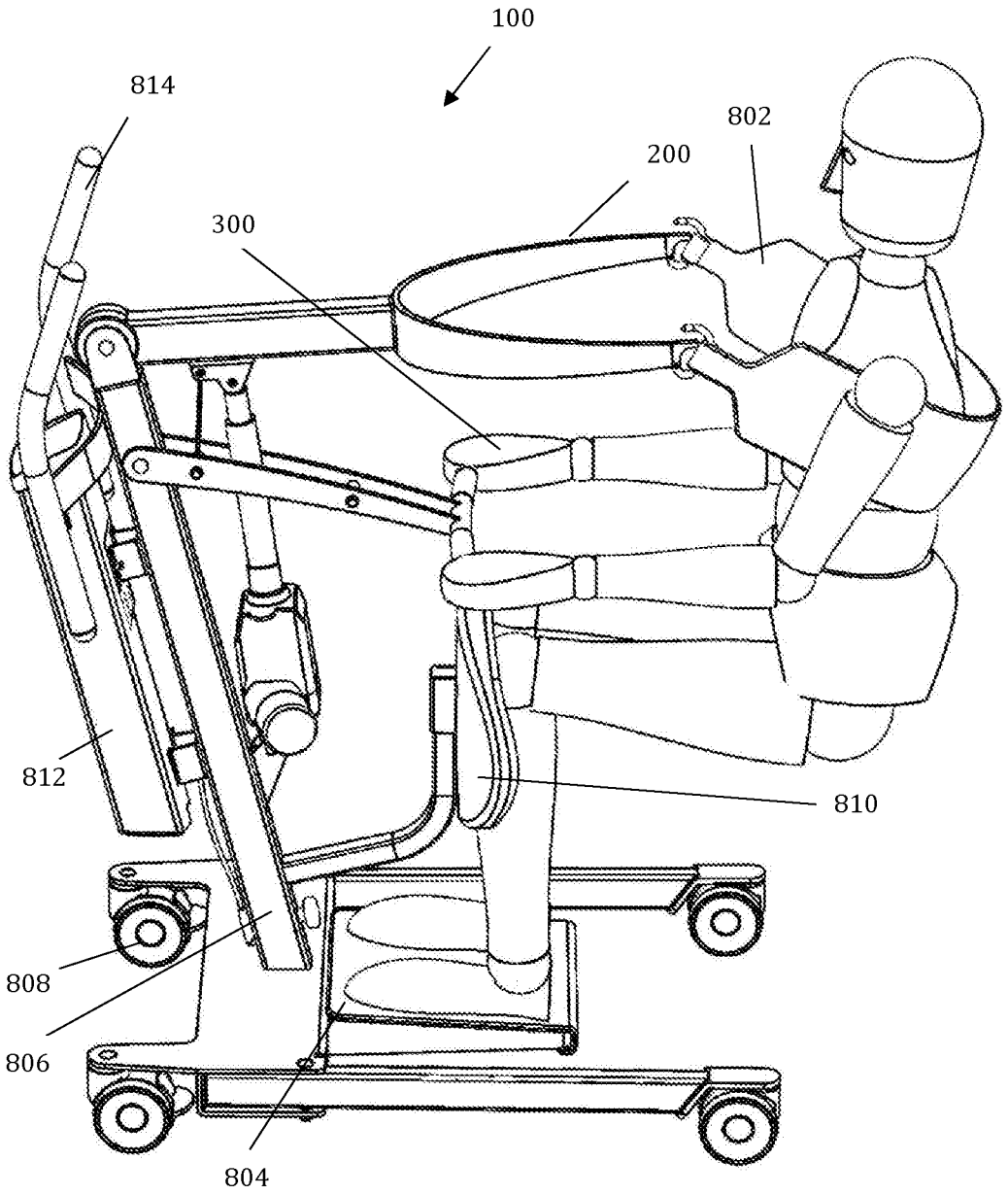
Figure 7:
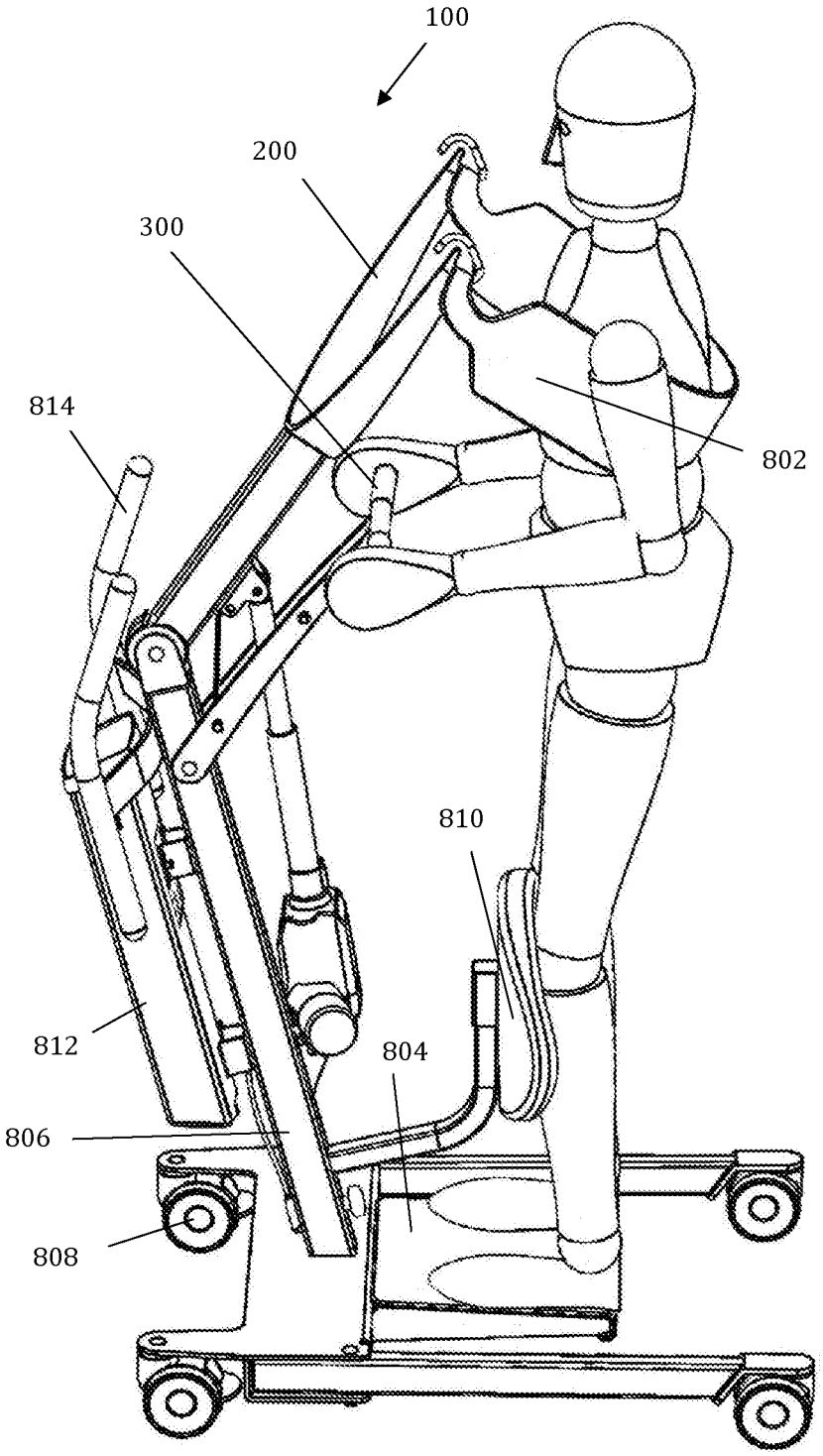
FIG. 7 illustrates a diagrammatic depiction of a user in a hoist according to one embodiment of the present invention, wherein the user is in a standing position.

By way of illustration, embodiments not being limited thereby, FIG. 5 and FIG. 6 show two different views of a hoist according to one exemplary embodiment in which a user assumes a seated position, and FIG. 7 shows a view of the hoist according to one exemplary embodiment in which a user has assumed a standing position. In these figures, the hoist 100 can be distinguished, as can the user. The exemplary hoist comprises the basic features of embodiments of the present invention such as the movable lifting arm 200, the connecting element 802, the movable handle 300, and also some optional features which may typically be present in a hoist, such as a plate 804 on which the user can place his feet, structural elements 806 on which the remaining elements may be mounted, wheels 808 whereby the hoist can be rolled around, a lower leg support 810 against which the user may place his lower legs, a motor element 812, further handles 814 for making the hoist easier to displace, etc.

In a second aspect, the present invention relates to a method for transferring an individual between firstly a seated or lying position and secondly a standing position, comprising:

a. connecting an individual to a hoist according to an embodiment of the first aspect by means of the connecting element,
b. gripping of the handle by the individual, and
c. operation of the hoist, thus facilitating the transition between firstly the seated or lying position and secondly the standing position of the individual.

In embodiments, features of the second aspect may be independent, as described accordingly for the other aspects and their embodiments.

In a third aspect, the present invention relates to a handle in a hoist according to an embodiment of the first aspect, wherein the handle shifts during operation of the hoist and executes a movement relative to the lifting arm of the hoist.

In embodiments, features of the third aspect may be independent, as described accordingly for the other aspects and their embodiments.

EXAMPLES

Various configurations for obtaining a handle which shifts during operation of a hoist, and also executes a movement relative to a lifting arm, are shown in FIGS. 1(*a*) to 4. These configurations each comprise a hoist 100 with a movable lifting arm 200 and a movable handle 300. A connecting element and the individual are not shown on the figures. In the examples shown, the movable lifting arm 200 is always rotatable about a rotation point 210, for example at the end of a stand 110; the arrow indicates the rotation of the lifting arm 200 when this performs an upward movement, e.g. while facilitating the standing movement of the individual. In the reverse movement, e.g. to a seated or lying position of the individual, the rotation is then opposite. In other examples (not shown), the lifting arm 200 may also be movable by translation (e.g. because the stand 110 can generate an upward or downward movement of the lifting arm), or by a combination of rotation and translation.

FIGS. 1(*a*) to 1(*f*) show configurations of the first type. In these examples, the movable handle 300 is rotatable about a rotation point 310. On an upward movement, the lever arm 200 exerts an upward force on the handle 300 with a proximal point of attack (viewed from the individual) relative to the rotation point 310. To transfer the force from the lever arm 200 to the handle 300, the two are connected by means of a coupling element 400 such as a chain or belt (FIG. 1(*a*)), a shackle connection (FIG. 1(*b*)), a bridge connection (FIG. 1(*c*)), a piston (FIG. 1(*d*)), a guided chain or belt (optionally equipped with a spring 401; FIG. 1(*e*)), or a sliding shackle connection (FIG. 1(*f*)). In the example shown, the maximal length of this coupling element 400 is always greater than the distance between the lifting arm 200 and the handle 300 in the first phase of operation of the hoist. Thus, in the first phase, only the lifting arm 200 moves and not the handle 300. When the distance between the two is sufficiently large, the force from the lever arm 200 is transferred to the handle 300 via the coupling element 400, and during the second phase both elements move. On a downward movement, the same procedure is applied in reverse.

Figure 2A:
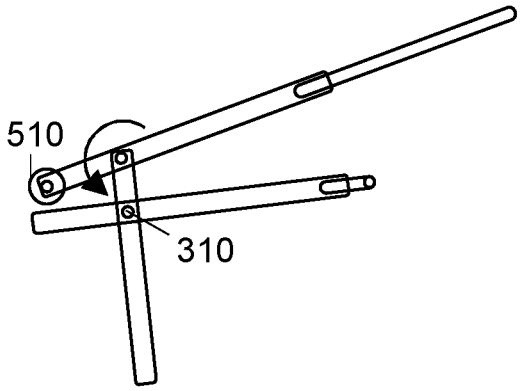
Figure 2B:
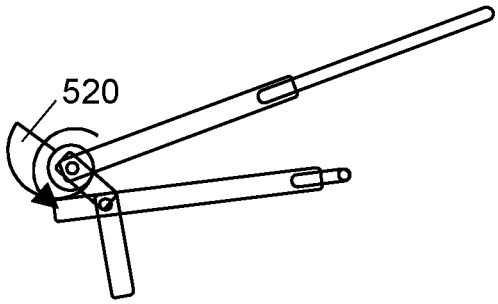

FIGS. 2(*a*) and 2(*b*) show configurations of a second type. In these examples, the movable handle 300 is again rotatable about a rotation point 310. On an upward movement, the lifting arm 200 here however exerts a downward force on the handle 300 with a distal point of attack (viewed from the individual) relative to the rotation point 310. Here for example, a distal end of the lifting arm 200 presses on a distal end of the handle 300. FIG. 2(*a*) shows an example with a pressure element 510 which, during the first phase of operation of the hoist, is still at a distance from the handle 300, whereby in the first phase again only the lifting arm 200 moves. When the distance between the two has been bridged, the force from the lifting arm 200 is transferred to the handle 300 via the pressure element 510; in the second phase, both elements therefore move. FIG. 2(*b*) shows an example with a cam element 520, by means of which, throughout the operation of the hoist, a non-constant rotation speed is transferred from the lifting arm 200 to the handle 300. On a downward movement, again the same procedures are applied in reverse.

Figure 3A:
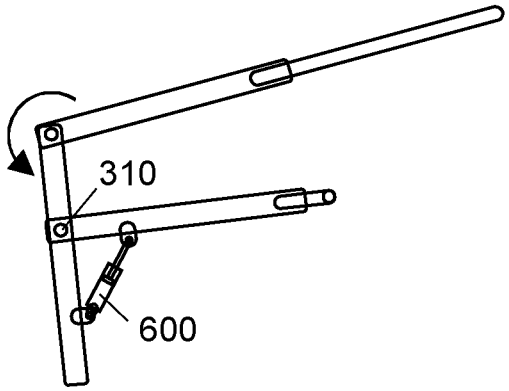
Figure 3B:
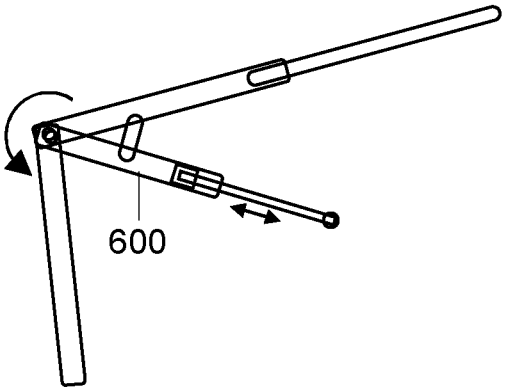

FIGS. 3(*a*) and 3(*b*) show configurations of a third type. Here, a separate actuator 600 is used for the handle 300. FIG. 3(*a*) shows an example in which the handle 300 is rotatable about the rotation point 310 under the influence of this actuator 600. FIG. 3(*b*) shows an example in which the handle 300 can be retracted and/or extended under the influence of the actuator 600.

Figure 4:
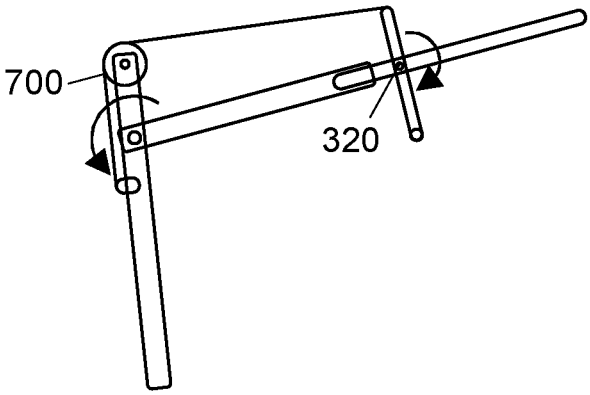

FIG. 4 shows a configuration of a fourth type. Here, the handle 300 is attached to the lifting arm 200 at rotation point 320. In cooperation with a pulley system 700, on movement of the lifting arm 200, a movement of the handle 300 relative to the lifting arm 200 is thereby generated.

In one configuration (not shown), the movement of the handle may also be coupled to that of the lifting arm by means of interacting gearwheels. By suitable choice of gear wheel size, for example a differing rotation speed between the lifting arm and the handle can thus easily be obtained.

The various aspects may easily be combined with each other and the combinations thus also correspond to embodiments according to the present invention.

The invention claimed is:

1. A hoist for facilitating a transition between firstly a seated or lying position and secondly a standing position of an individual, comprising:

i) a movable lifting arm for exerting a lifting force;

ii) a connecting element for transferring the lifting force from the lifting arm to the individual; and iii) a movable handgrip configured for supporting the hands of the individual during operation of the hoist, wherein the movable handgrip is configured to shift during operation of the hoist, and wherein during operation of the hoist, the movable handgrip also executes a movement relative to the lifting arm;

wherein the handgrip is configured relative to the lifting arm such that, during operation of the hoist:

in a first phase, the lifting arm is in motion but not the handgrip, and in a second phase, both the handgrip and the lifting arm are in motion.

2. The hoist according to claim 1, wherein the handgrip is positioned such that when the individual grips the handgrip, an angle between an arm and a torso of the individual is less than or equal to 90°.

3. The hoist according to claim 1, wherein the handgrip is connected to the lifting arm in such a way that a force from the lifting arm in the first phase is not transferred to the handgrip, and in the second phase is transferred to the handgrip.

4. The hoist according to claim 3, wherein the movement of the handgrip comprises a rotation about a rotation point, and wherein the force from the lifting arm on the handgrip is an upward force with a proximal point of attack relative to the rotation point, viewed from the individual.

5. The hoist according to claim 1, wherein the movement of the handgrip comprises a rotation about a rotation point, and wherein the force from the lifting arm on the handgrip is a downward force with a distal point of attack relative to the rotation point, viewed from the individual.

6. The hoist according to claim 1, wherein the lifting arm and the handgrip are connected by means of a chain or a pivoting coupling element, wherein the maximal length of the chain or pivoting coupling element is greater than the distance between the lifting arm and the handgrip in the first phase of operation of the hoist.

7. The hoist according to claim 1, wherein the hoist comprises a separate actuator for the handgrip and a separate actuator for the lifting arm.

8. The hoist according to claim 1, wherein the handgrip is configured relative to the lifting arm such that during operation of the hoist, the handgrip moves at a different speed from the lifting arm.

9. The hoist according to claim 8, wherein the handgrip moves more slowly than the lifting arm.

10. The hoist according to claim 1, wherein the lifting arm and the handgrip are driven by the same motor.

11. The hoist according to claim 1, wherein the connecting element is a lifting strap to be placed around the individual and connected to the lifting arm.

12. The hoist according to claim 11, wherein the lifting strap is placed around a torso of the individual.

13. The hoist according to claim 1, wherein the handgrip is configured to shift during operation of the hoist and executes a movement relative to the lifting arm of the hoist.

14. The hoist according to claim 1, wherein the handgrip is positioned such that when the individual grips the handgrip, an angle between an arm and a torso of the individual is less than or equal to 70°.

15. The hoist according to claim 1, wherein the handgrip is positioned such that when the individual grips the handgrip, an angle between an arm and a torso of the individual is less than or equal to 50°.

16. The hoist according to claim 1, wherein the handgrip is positioned such that when the individual grips the handgrip, an angle between an arm and a torso of the individual is less than or equal to 30°.

17. A method for transferring an individual between firstly a seated or lying position and secondly a standing position, comprising:

a. connecting an individual to a hoist having a movable lifting arm for exerting a lifting force and a connecting element for transferring the lifting force from the lifting arm to the individual, said connecting element connecting the individual to the hoist;

b. gripping a movable handgrip of the hoist by the individual, the movable handgrip suitable for supporting the hands of the individual during operation of the hoist, wherein the movable handgrip is configured to shift during operation of the hoist, and wherein during operation of the hoist, the movable handgrip also executes a movement relative to the lifting arm; and c. operating the hoist, thus facilitating the transition between firstly the seated or lying position and secondly the standing position of the individual;

wherein operating the hoist comprises:

in a first phase, the lifting arm in motion but not the handgrip, and in a second phase, both the handgrip and the lifting arm in motion.

* * * * *